United States Patent [19]

Taylor, Jr. et al.

[11] Patent Number: 4,683,597

[45] Date of Patent: Aug. 4, 1987

[54] DRAIN PLUG

[76] Inventors: William R. Taylor, Jr., 217 Via Dijon, Newport Beach, Calif. 92663; Robert L. Taylor, 5251 Monroe St. #7, Stanton, Calif. 90680; Richard H. Taylor, 12672 Barrett La., Santa Ana, Calif. 92705

[21] Appl. No.: 920,757

[22] Filed: Oct. 20, 1986

Related U.S. Application Data

[63] Continuation of Ser. No. 723,736, Apr. 16, 1985.

[51] Int. Cl.[4] ..... A47K 1/14

[52] U.S. Cl. ..... 4/295; 4/286; 138/89

[58] Field of Search ..... 4/295, 286; 138/89

[56] References Cited

U.S. PATENT DOCUMENTS

| | | | |
|---|---|---|---|
| 2,155,491 | 4/1939 | Jacobs | 138/89 |
| 2,245,887 | 6/1941 | Wikanden | 4/295 |
| 2,479,862 | 8/1949 | Payne | 4/295 |
| 2,750,601 | 6/1956 | Houle | 4/295 |
| 2,993,616 | 7/1961 | Canlile, Jr. et al. | 138/89 X |
| 3,509,918 | 5/1970 | Muzinich | 138/89 X |
| 3,618,809 | 11/1971 | Martino | 138/89 X |
| 3,749,131 | 7/1973 | Burger | 138/89 |
| 4,493,344 | 1/1985 | Mathison et al. | 138/89 |

*Primary Examiner*—Henry K. Artis

*Attorney, Agent, or Firm*—Blakely, Sokoloff, Taylor & Zafman

[57] ABSTRACT

A drain plug for sealing the waste and overflow drain assemblies during construction and system testing. A threaded bolt extends through a rubber washer. The bolt is screwed into a tapped hole in the shoe assembly of the drain, providing a secure plug that will not blow out during system testing. A sleeve may be employed on the bolt to allow ease of access to the bolt when deep drains are plugged.

18 Claims, 6 Drawing Figures

DRAIN PLUG

This is a continuation of application Ser. No. 723,736 filed 4/16/85.

BACKGROUND OF THE INVENTION

1. Field of the Invention

This invention relates to the field of drain plugs and more particularly, those plugs used while conducting pressure tests on plumbing systems.

2. Prior Art

On newly constructed plumbing systems, it is desired to plug all drains with a stopper. The drains include the waste drain and overflow drains of bathtubs. The drains are plugged for a variety of reasons but two major reasons are first to prevent waste material generated by construction from entering the drains and second to allow pressure testing of the plumbing system. The pressure test is typically required during a building department inspection. The pressure test consists of plugging all drains with stoppers and filling the pipes of the plumbing system with water. The waste drain and overflow drain are usually coupled to the same pipe but must be plugged individually to provide a seal. The drains are plugged and the pipes remain filled with water for an extended period of time while a building inspection takes place. During the test, vent pipes extending from the drain are typically filled with water to a level of 10 feet above the level of the drains.

The prior art method of blocking the drains is to place a dollar plug in the waste assembly and a plastic plug, dollar plug or Jim cap in the overflow assembly.

A dollar plug is illustrated in FIG. 1 and consists of a large rubber "accordian" washer sandwiched between two large metal washers. A threaded bolt extends through the washers and is secured by a wingnut.

A plastic plug simply fits inside of the drain to create a pressure seal and a Jim cap is comprised of a rubber plug with an outer sleeve. The plug fits into a pipe with the sleeve extending over the pipe.

A major disadvantage of dollar plugs and other prior art plugs is their tendency to blow out under pressure during the testing of the plumbing system. Since the plugs rely only on friction between the side wall of the drain and the rubber washer to form a seal, any water pressure of sufficient force to overcome that friction will cause the plug to fail or "blow out".

A second disadvantage of the dollar plug is their tendency to scratch and scar the finish of the drain. This is primarily due to the construction of the dollar plug which exposes metal parts to contact with the finish of the drain. As shown in FIG. 1, the upper metal washer extends over the rubber washer. This metal will come in contact with the finish of the drain, marring and scratching the surface.

Third, when plastic plugs, Jim caps or dollar plugs are used to plug the overflow assembly, an additional trip is required after the inspection test to install the overflow shoe and trim. This involves considerable labor cost.

It is an object of the present invention to provide a drain plug which will not blow out during the pressure testing.

It is another object of the present invention to provide a plug with no metal to finish contact when properly installed.

Yet another object of the present invention is to provide a drain plug which allows a one trip connection of the waste and overflow assembly.

SUMMARY OF THE PRESENT INVENTION

The present invention consists of a thumb screw inserted through a metal washer, a rubber washer and a keeper ring. The thumb screw protrudes through the washer assembly, allowing it to be screwed into the tapped shoe assembly of a drain. The screw prevents the plug from blowing out during pressure testing. The plug can be screwed into the shoe of the overflow assembly, eliminating the need for installation of the shoe after pressure testing.

DETAILED DESCRIPTION OF THE PRESENT INVENTION

A drain plug which screws directly into the shoe of a drain assembly is described. In the following description, numerous specific details are set forth, such as screw length, washer size etc., in order to provide a thorough understanding of the present invention. It will be obvious however, to one skilled in the art, that the present invention may be practiced without these specific details. In other instances, well known structures have not been described in detail in order not to unnecessarily obscure the present invention.

Prior Art

Figure 2:
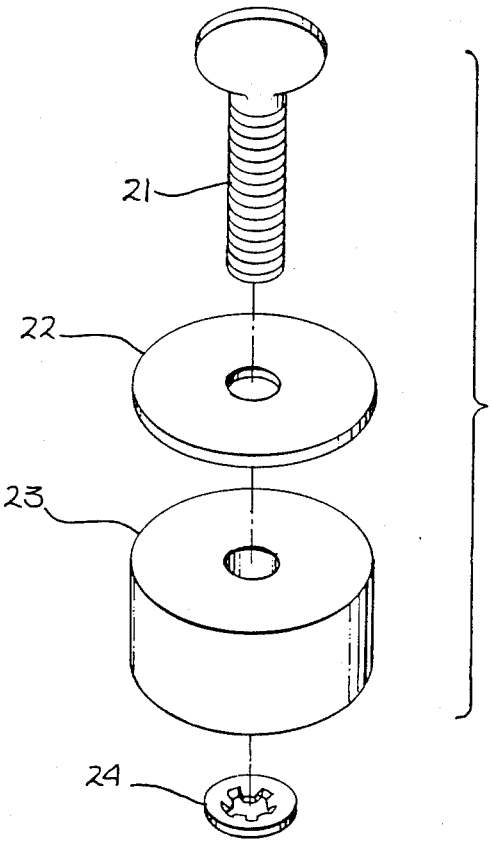
FIG. 2 illustrates a perspective view of the preferred embodiment of the present invention.

An example of a prior art drain plug, namely a dollar plug, is shown in FIG. 2. A threaded bolt 11 extends through a small rubber washer 10, a metal washer 12, a large rubber washer 13, a second metal washer 14, and a wing nut 15. The dollar plug is inserted into a drain and the wing nut 15 is tightened, with subsequent pressure on the rubber washer 13 causing it to expand against the walls of the drain. The nut 15 is tightened until the rubber washer 13 forms a seal with the drain.

Because the plug is secured only by the pressure of the washer 13 on the walls of the drain, whenever pressure during a system test exceeds the frictional force of the washer and the drain, the plug will be blown out of the drain.

Both the metal washer 12 and the metal washer 14 come into contact with finished portions of the drain assembly. This contact can scratch the finished surface, leaving nicks and scars. The first washer 12 contacts the shoe assembly, which has a finished surface, while the second washer 14 contacts the drain collar. When the wing nut is tightened, there may be movement of the metal washers 12 and 14, further increasing the chance of abrasion.

Figure 1:
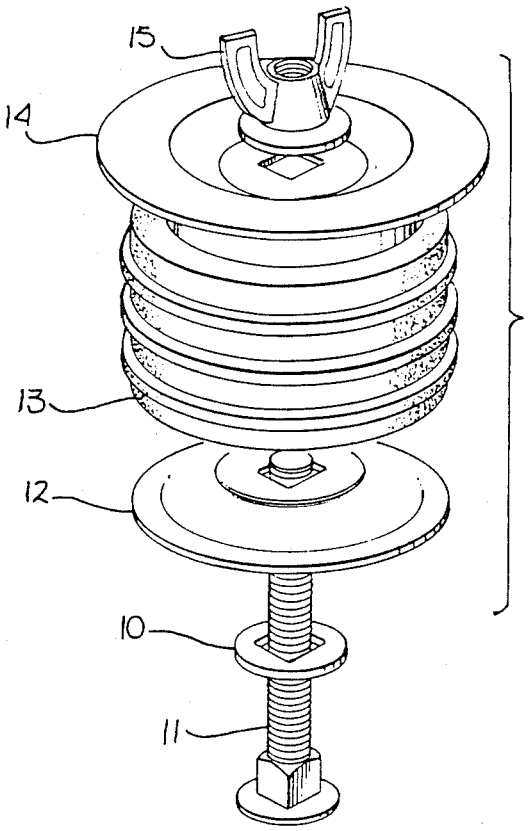
Fig. 1 PRIOR ART
FIG. 1 illustrates a perspective view of a prior art drain plug.

The plug of FIG. 1 cannot be used to plug the overflow assembly while the shoe and trim are present. When the shoe assembly is in place in the overflow drain, the distance between the surface of the drain and the shoe is very small. This distance is too shallow to permit more than a small portion of the dollar plug to rest in the overflow drain. The amount of plug that extends into the drain is too little to support the plug or form an adequate seal. Thus the dollar plug cannot be utilized with the shoe in place. This requires that the plug be installed prior to the pressure test, with the shoe and trim added after the test. This extra installation step must typically be performed by a plumbing contractor, adding to the expense of construction.

Present Invention

Figure 5:
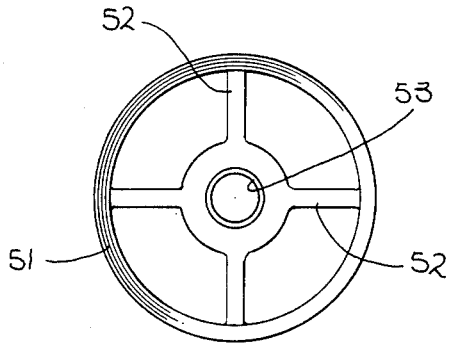
FIG. 5 illustrates a top view of a tapped shoe assembly.
Figure 6:
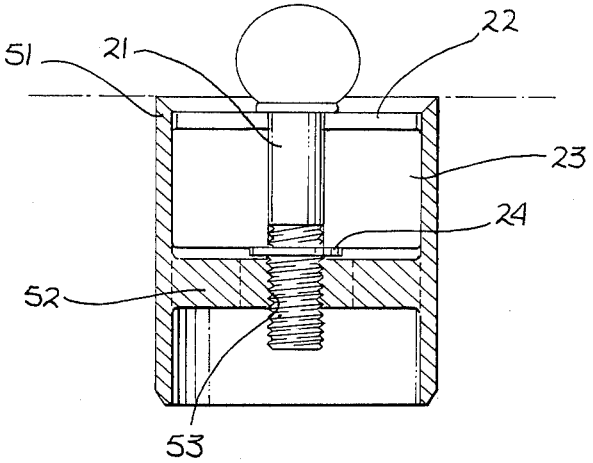
FIG. 6 is a cross-sectional view of the present invention in cooperation with the tapped shoe assembly of FIG. 5.

The preferred embodiment of the present invention is illustrated in FIG. 2. A thumb screw 21 is inserted through a 1½" washer 22, a rubber washer 23 and a keeper ring 24. Approximately ¼" to ½" of threads protrude past the keeper ring 24 to enable the plug assembly to be screwed directly into the waste drain. The waste drain 51 (FIG. 5) contains a shoe assembly 52 which includes a tapped hole 53 in the center as shown in FIG. 6, the threads of the screw 21 are inserted into this hole 53 and screwed in to secure the assembly to the drain 51. The thumb screw 21 is tightened until the rubber washer 23 expands to form a water tight seal with the drain 51. The screws are comprised of metal, such as steel or iron, in the preferred embodiment, but any suitable material may be used.

Figure 3:
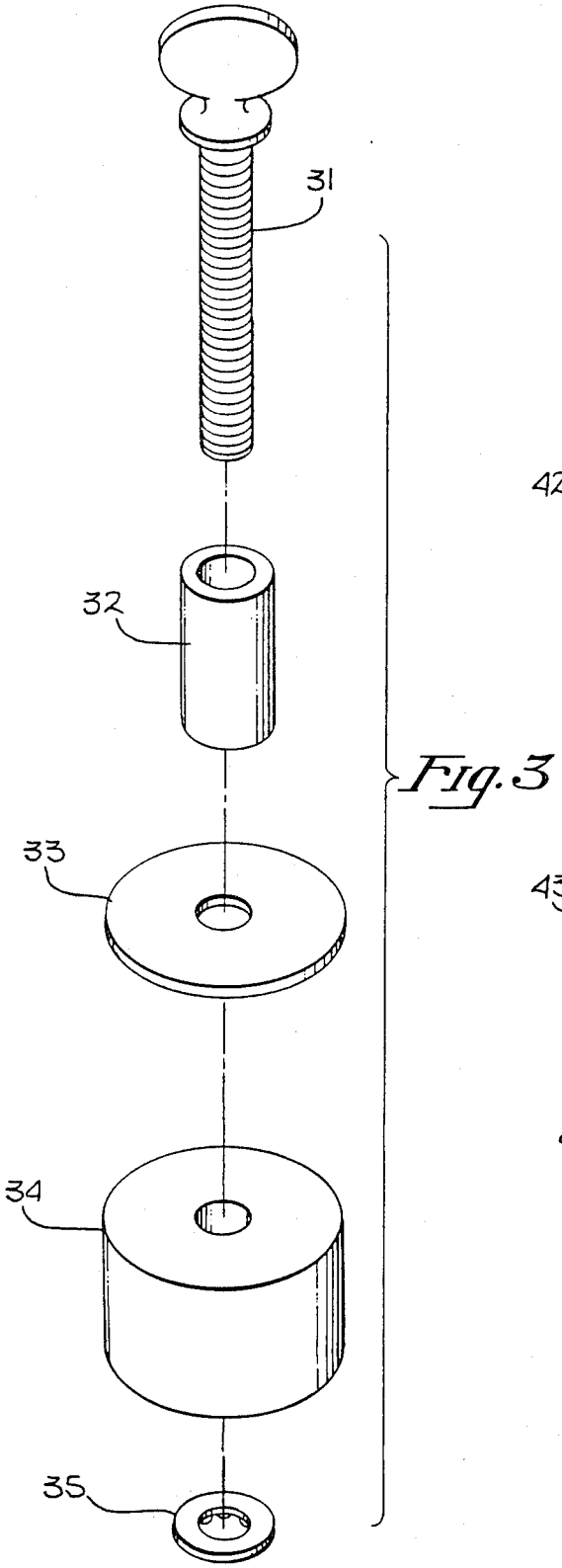
FIG. 3 illustrates a perspective view of an alternative embodiment of the present invention.

If the shoe assembly is more than a certain distance below the level of the drain, the plug when utilized will result in the screw 21 also being below the level of the drain. This may make the screw difficult to access. This problem can be alleviated by the embodiment of the present invention shown in FIG. 3. There a thumb screw is inserted first through a sleeve 32 and then a metal washer 33, a rubber washer 34 and a keeper ring 35. A longer screw 31 is used so there will still be ¼" to ½" of threads extending past the keeper ring 35. The sleeve 32 keeps the thumb screw above the level of the drain for easy manipulation.

The advantage of the present invention over prior art plugs is clear, it will not blow out during pressure tests. Additionally, the present invention will not harm the finish of the drain. The metal washers are smaller than the width of the rubber washers. As a result, the only metal to metal contact is the thumb screw with the tapped hole of the drain shoe. The rubber will not harm the finish of the drain. To further reduce the likelihood of damage to the finish, the metal parts of the present invention can be replaced with plastic.

Figure 4:
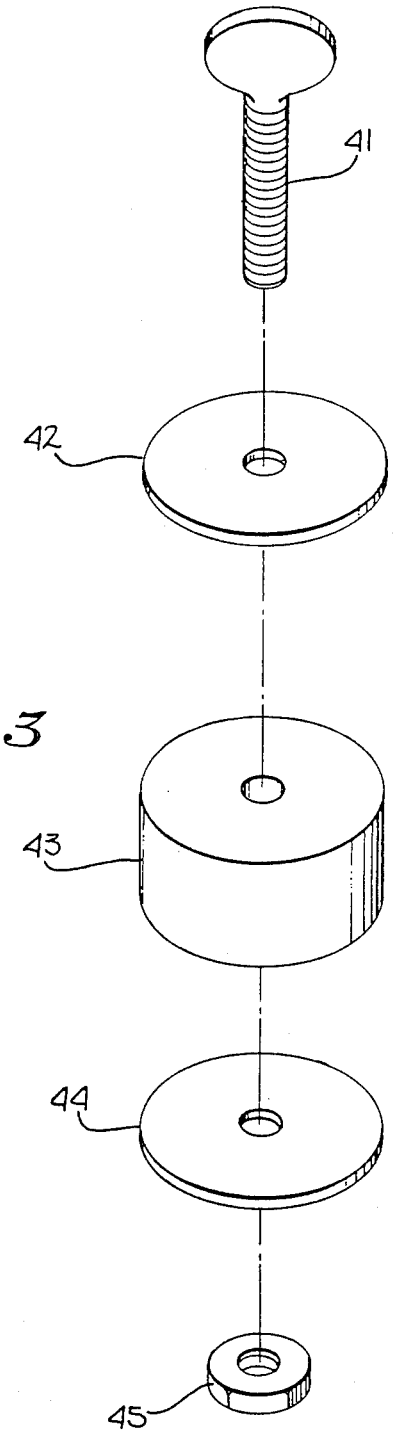
FIG. 4 illustrates a perspective view of yet another alternative embodiment of the present invention.

A costly installation step is saved through use of the present invention. The shoe and trim of the overflow assembly can be installed simultaneously with the waste assembly. The present invention can seal the overflow assembly even after the shoe has been installed. The embodiment shown in FIG. 4 is used to plug the overflow drain. The rubber washer 43 is sandwiched between two metal washers 42 and 44. The washers are secured by the threaded nut 45. Again approximtely ¼" and ½" of the threaded screw 41 extends below the nut 45. The drain plug is screwed into the tapped hole of the overflow shoe. Although the overflow drain is shallow, by screwing the plug of the present invention into the tapped hole of the shoe, the plug can be held in place, even during system testing. The use of metal washers on both sides of the rubber washers permits the rubber washer to be tightened and expanded so that even if only a small portion of the washer extends into the overflow drain, a seal will be formed. This feature allows the plug to be used in the overflow drain even with the shoe assembly installed. Thus, after the pressure test, only the plugs must be removed, with no further installation of parts required.

Although the preferred embodiment of the present invention utilizes a rubber washer, any suitable resilient material which can form a watertight seal may be utilized. For example, a pliable plastic washer may be used.

Thus, a drain plug has been described which provides a secure seal during pressure testing and can be used on a completed drain assembly.

We claim:

1. A drain/stopper device comprising:

a drain including a shoe assembly having a tapped hole therethrough;

a first washer comprised of resilient material, said first washer having a longitudinal opening therethrough, said first washer having substantially the same diameter as said drain;

a screw having a head at one end thereof for turning said screw, said screw extending through said opening in said first washer and threadedly engaging said tapped hole of said shoe assembly;

whereby said device will remain in place in said drain even when acted on by water pressure.

2. The device as described by claim 1 wherein a second washer is disposed on said screw between said head and said first washer such that the tightening of said screw in said tapped hole of said shoe assembly will cause expansion of said first washer.

3. The device as described by claim 1 wherein a keeper ring is disposed on said screw between said first washer and on the end of said screw opposite said head.

4. The device as defined by claim 1 wherein said first washer is comprised of rubber.

5. A drain/stopper device comprising:

a drain including a shoe assembly having a tapped hole therethrough;

a first washer comprised of resilient material, said first washer having a longitudinal opening therethrough, said first washer having substantially the same diameter as said drain;

a screw having a head at one end thereof for turning said screw, said screw extending through said opening in said first washer;

a sleeve disposed on said screw between said head of said screw and said first washer, said sleeve of such length that the threads of said screw extend below said first washer;

said screw extending through said first washer for threaded engagement with said tapped hole and said shoe assembly;

whereby said device can seal said drain and said head of said screw can be easily and conveniently accessed.

6. The device as described in claim 5 wherein a second washer is disposed on said screw between said first washer and said sleeve, such that tightening of said screw causes expansion of said first washer.

7. The device as described by claim 6 wherein a keeper ring is disposed on said screw between said first washer and the end of said screw opposite said head.

8. The device as described by claim 7 wherein said sleeve, said screw, said second washer and said keeper ring are comprised of metal.

9. The device as described by claim 7 wherein said sleeve, said screw, said second washer and said keeper ring are comprised of plastic.

10. The device as described by claim 7 wherein said first washer is comprised of rubber.

11. A drain/stopper device comprising:

a drain including a shoe assembly having a tapped hole therethrough;

a first washer comprised of resilient material, said first washer having a longitudinal opening therethrough, said first washer having substantially the same diameter as said drain;

second and third washers disposed on opposite sides of said first washer;

a screw having a head at one end thereof for turning said screw, said screw extending through said opening of said first washer and said second and third washers, said head abutting said second washer, said screw threadedly engaging said tapped hole;

a nut disposed on said screw and abutting said third washer, said nut when tightened causing the expansion of said first washer;

whereby said device can seal said drain.

12. The device as described by claim 11 wherein said first washer is comprised of rubber.

13. The evice as described by claim 11 wherein said screw is comprised of metal.

14. The device as described by claim 11 wherein said second and third washers are comprised of metal.

15. The device as described by claim 11 wherein said nut is comprised of metal.

16. The device as described in claim 11 wherein said second and third washers are comprised of plastic.

17. The device as described in claim 11 wherein said screw is comprised of plastic.

18. The device as described in claim 11 wherein said nut is comprised of plastic.

* * * * *